United States Patent [19]

Over

[11] Patent Number: 4,894,973

[45] Date of Patent: Jan. 23, 1990

[54] REINFORCING AND MOUNTING STRUCTURE FOR FRAMES

[76] Inventor: Helmut Over, Hallstattweg 4, 5352 Zuelpich, Fed. Rep. of Germany

[21] Appl. No.: 209,345

[22] Filed: Jun. 20, 1988

[30] Foreign Application Priority Data

Oct. 21, 1987 [DE] Fed. Rep. of Germany ... 8714076[U]

[51] Int. Cl.[4] ..... E04C 3/30

[52] U.S. Cl. ..... 52/732; 52/731

[58] Field of Search ..... 52/731, 732, 729

[56] References Cited

U.S. PATENT DOCUMENTS

| | | | |
|---|---|---|---|
| 3,282,016 | 11/1966 | Dennery | 52/732 |
| 3,349,538 | 10/1967 | Crossman | 52/731 |
| 3,483,665 | 12/1969 | Miller | 52/729 X |
| 4,640,078 | 2/1987 | Haffer | 52/731 |
| 4,773,192 | 9/1988 | Andrews | 52/729 X |

*Primary Examiner*—Carl D. Friedman

*Attorney, Agent, or Firm*—W. G. Fasse; D. H. Kane, Jr.

[57] ABSTRACT

A reinforcing and mounting structure for frames, especially window frames, has an inner metal sectional insert fitting into a hollow channel frame member and frame cover elements surrounding the hollow channel frame member on at least three sides. The sectional insert is wedged into the hollow channel frame member and attached at its end faces by screws to frame elements of the frame such as a window frame. The improved mounting structure is less expensive to produce, easier to install, and achieves a considerably increased strength and loadability with the same cross-sectional dimensions relative to prior structures. The sectional insert includes two sectional insert halves (1*a*, 1*b*) arranged back-to-back in a mirror image fashion. Each sectional insert half (1*a*, 1*b*) essentially has a configuration with a U-shape cross-section with a base shank and two leg shanks. The base shanks of the two insert halves (1*a*, 1*b*) are arranged back-to-back to face each other and include pleats (4, 5) extending in the lengthwise direction and running in parallel at a spacing from one another to form together two hollow screw channels (6, 7). The screws wedge the leg shanks apart, thereby securing the insert in the hollow channel and simultaneously securing frame members to each other.

8 Claims, 2 Drawing Sheets

REINFORCING AND MOUNTING STRUCTURE FOR FRAMES

CROSS-REFERENCE TO RELATED APPLICATION

This invention relates to U.S. Ser. No. 209,346, filed in the U.S.A. simultaneously with the present application and entitled: STRUCTURAL SUPPORT MEMBER FOR WINDOW FRAMES OR THE LIKE.

FIELD OF THE INVENTION

The invention relates to a reinforcing and mounting structure for frames, especially window frames or the like, with a metal sectional hollow channel frame member and a facing frame member surrounding the metal channel frame member on at least three sides. The metal sectional channel is connected by means of screws at its end faces to frame elements of the frame such as a window frame.

DESCRIPTION OF THE PRIOR ART

Reinforcing and mounting structures include intermediately located support frame members which are typically used for multi-winged, or multi-paned window frames for dividing the total window surface area into separate panels. Such intermediate support members are usually hollow-sectional channel frame members made of plastic and including an inner metal box cross-section channel member which provides the necessary strength or stiffness of the intermediate support member or carrier. The box-section channel member includes a central screw channel which is attached to the channel member walls by appropriate webs.

The manufacture of such box-section intermediate channel members is rather expensive. Usually, aluminum is used as the material for the box-section channel member so that the production or manufacturing costs can be held at least to a barely acceptable level. However, aluminum as such is rather expensive. Besides, aluminum has a considerably lower modulus of elasticity than that, for example of steel. Furthermore, the installation of such conventional sectional channel members is quite involved and costly, because the sectional member must be screwed to the side walls of the facing frame member surrounding the insert in order to prevent rattling, which could otherwise be caused by movements of the frame caused by alternating loading conditions, e.g. wind loads. Additionally, a so-called shoe which is attached to a frame member of the window frame is often used for securing the respective end faces of the sectional channel members. In order to achieve this, the sleeve is inserted into the respective end face of the box-section channel member and then secured by screws extending through the frame. This type of conventional assembly requires additional production costs and also additional installation costs and efforts.

The ultimate load carrying ability of such intermediate support members or carriers, for example for taking up wind forces applied to large surface windows, is quite limited due to the use of aluminum for the box-section channel member. This could only be remedied in conventional structures using channel sections having inordinately large cross-sectional dimensions.

OBJECTS OF THE INVENTION

In view of the foregoing it is the aim of the invention to achieve the following objects singly or in combination:

to construct an intermediate reinforcing and mounting structure or support member or carrier for frames, especially window frames so as to considerably increase the strength and loadability of the carrier structure while maintaining the same or even smaller cross-sectional dimensions of the carrier as compared to prior supporting members or carriers;

to reduce production costs of such an intermediate support member by making it of less expensive materials in a simple and less costly manufacturing process; and to construct such an intermediate support member so that it is easily installable and requires fewer screw connections in order to achieve an effective, rigid connection with a neighboring frame member such as a window frame member.

SUMMARY OF THE INVENTION

The above objects have been achieved according to the invention in an intermediate reinforcing and mounting structure or support member for a frame or window frame, wherein a sectional hollow channel member holds an insert of two similarly shaped sectional insert halves which are arranged back-to-back in a mirror image fashion. Each sectional insert half essentially has a U-shape, whereby the respective base shanks of the U-shaped insert halves are arranged so that they may contact each other back-to-back when the insert halves are inserted into the hollow channel member. Each base shank comprises at least one, preferably two pleats extending in the lengthwise direction and running in parallel at a distance apart from one another. When the two insert halves are arranged in a mirror image fashion as described above, the respective pleats together form one or two screw channels inside the hollow channel member.

The sectional insert according to the invention is preferably dimensioned so that it may easily be inserted with some lateral play into the lengthwise extending hollow chamber of the hollow channel member of the window frame. When screws are screwed into the screw channels, the two insert halves forming the sectional insert are slightly wedged or spread apart so as to take up this small play and tightly clamp both insert into the hollow channel formed in the frame member. In order to achieve greater rigidity and strength, the parallel legs or shanks of each U-shaped insert section half may comprise additional bent or folded rims or may even be folded completely back on themselves and against the base shank of the U-shape. In order to achieve a high strength, relatively low cost, and easy manufacturability, the insert halves are preferably made as separate sheet elements.

Another advantage of the invention is seen in that conventional facing frame members of window frames may maintain their previous or typical dimensions without any changes due to using the mounting or support member according to the invention. Two insert section halves according to the invention must simply be cut to appropriate length, and may then be placed into the hollow channel in a back-to-back or mirror image configuration. Insertion may be one half at a time, or both halves together. Then, screws are screwed through the end face frame elements of the window frame into the two parallel screw channels provided in each insert member, so that the ends of each insert member are pulled tightly against the respective frame element. The screws, which are screwed into the screw channels, cut their own threading into the screw channel, whereby the screws simultaneously slightly wedge open the screw channel so as to press the two insert halves apart from one another, thereby pressing the outer edge of the parallel legs or shanks of each insert half tightly against the inner surfaces of the walls of the hollow channel member surrounding the insert member.

It is possible that the two insert halves are attached to each other in the middle of the base shanks, for example, by spot welding. In that case only the free ends of the two halves would be wedged sufficiently apart by the inserted screws, whereby the base shanks would slightly bend to expand the parallel shank legs of each U-shape laterally against the side walls of the surrounding hollow channel frame member. In any of these embodiments it is not necessary to additionally screw the insert member to the walls of the facing frame member of the window frame.

The construction of the sectional insert member of two separate insert halves makes it possible to manufacture the sectional insert member from sheet metal, preferably sheet steel, by standard bending and rolling processes. The use of highly complicated and very expensive special tools for producing the sectional insert members is no longer required. In fact, simple and typical sheet metal tooling machines are completely sufficient. The use of sheet steel instead of aluminum makes the sectional insert members according to the invention considerably stronger and especially stiffer to resist bending. Furthermore, it is no longer required to produced complicated separate screw channels. In fact, it is quite sufficient for this purpose to provide simple square-angled pleats which are placed back-to-back against each other to leave a rectangular screw channel into which self-tapping or self-threading screws can easily be screwed.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
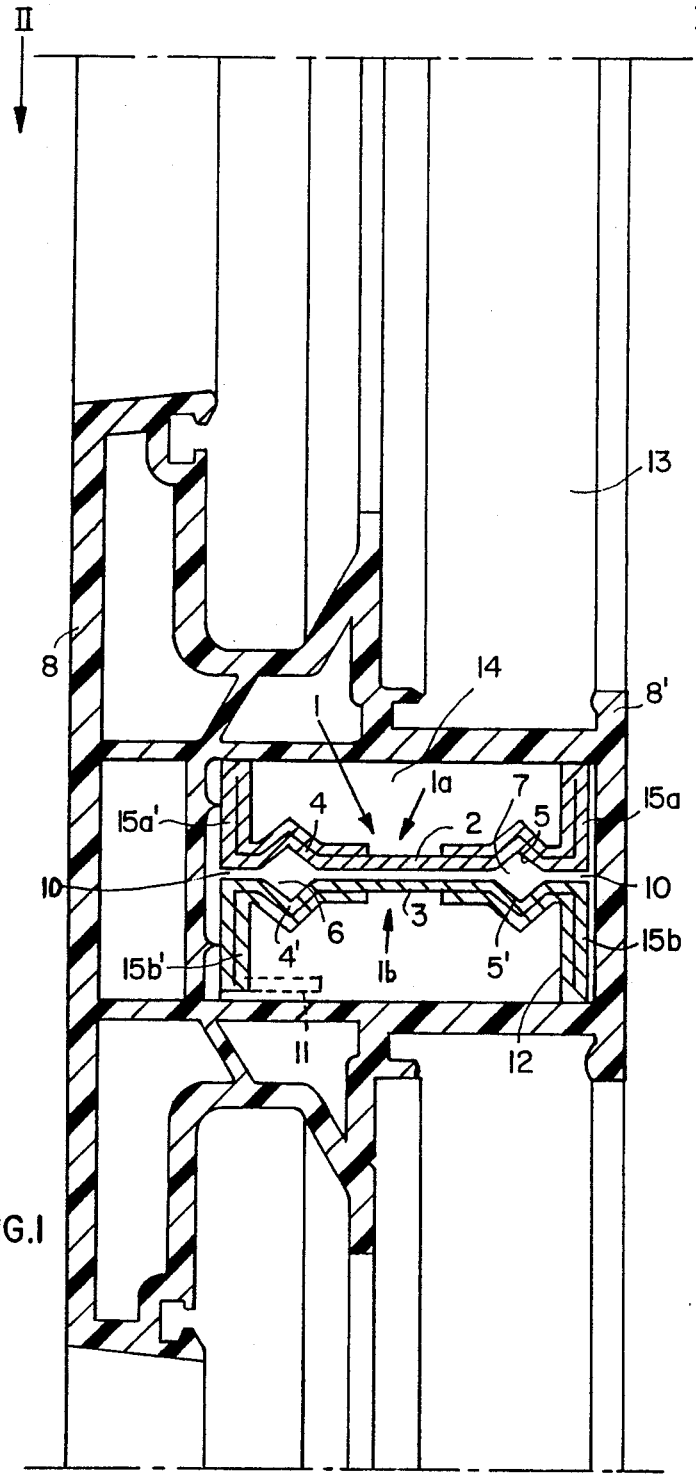
FIG. 1 is a cross-section through a hollow channel frame member including a sectional insert according to the invention and a surrounding window frame member essentially along section line I—I in FIG. 2, but rotated by 180°.
Figure 2:
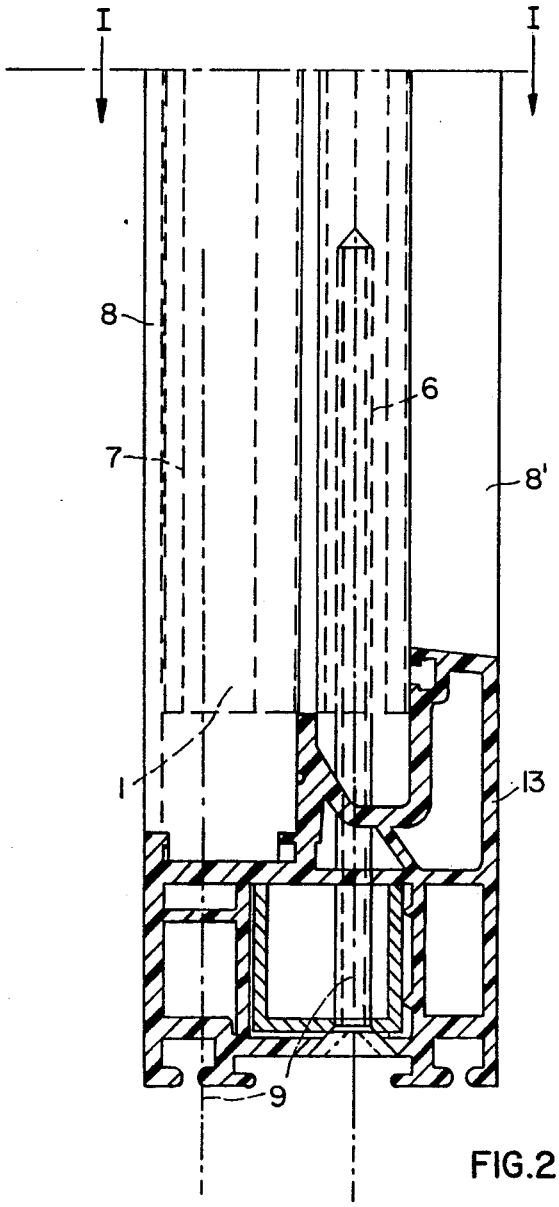
FIG. 2 is a lengthwise section through a frame member along the line II—II of FIG. 1.

FIG. 1 is a cross-sectional view through a reinforcing and mounting structure in the form of a facing frame member 8 including a hollow channel frame member 8' made of plastic material for example. The frame member 8, 8' stands perpendicularly on a frame element 13 of a window frame which is not described or referenced in detail. In FIG. 1 the frame members 8,8' are shown in section. FIG. 2 while correspondingly shows the frame element 13, in cross-section and the frame members 8,8' forming a reinforcing and mounting structure in a side view. As best seen in FIG. 1, a sectional insert 1, comprising two sectional insert halves 1*a* and 1*b* which are each folded and rolled from sheet steel, is located in the lengthwise extending hollow chamber 14 of the hollow channel frame member 8'. The insert halves 1*a* and 1*b* each have the same shape, but are arranged back-to-back in a mirror image fashion. Each sectional insert half 1*a*, 1*b* essentially has a U-shape cross-section, whereby preferably the base shank 2, 3 of each U-shape is longer than the respective two parallel side shanks 15*a*, 15*a'*, and 15*b*, 15*b'*. Each insert half has at least one, preferably two, pleats 4, 5 and pleats 4' and 5' running in parallel at a spacing from one another. These pleats are formed in the base shank 2, 3 of each insert half 1*a*, 1*b*. When the insert halves 1*a* and 1*b* are arranged back-to-back, the respective pleats 4 and 5 form or enclose an approximately rectangular hollow chamber which respectively forms a screw channel 6 or 7.

The free ends or lengthwise edges of the parallel side shanks 15*a*, 15*a'*, 15*b*, 15*b'* of each respective insert half 1*a*, 1*b* may comprise a flange or rim 11 bent inwardly at approximately a right angle in order to increase the torsional stiffness of the sectional insert 1. However, preferably, the parallel shanks 15*a*, 15*a'*, 15*b*, 15*b'* each comprise a rim 12 which is completely folded over to follow back along the respective shank and then folded further back on the base shank 2 or 3 so as to cover over the respective pleats 4, 5; 4', 5' as shown in FIG. 1.

Referring to FIG. 2, when screws 9 have been screwed from the end faces through the frame element 13 of the window frame and into the screw channels 6 and 7, the sectional insert halves 1*a* and 1*b* are spread or wedged apart by the spacing 10, seen in FIG. 1. Before the screws 9 were screwed into the screw channels 6 and 7, the spacing 10 existed as play between the walls of the hollow chamber 14 of the hollow channel frame member 8' and the respective lengthwise edges of the parallel shanks 15*a*, 15*a'* and 15*b*, 15*b'* of the insert halves 1*a* and 1*b*. In this manner, it is achieved, according to the invention, that the insert halves 1*a* and 1*b* may be easily inserted with ample play into the respective hollow chamber 14 of the facing frame member 8', yet then may be rigidly wedged or clamped in place in the facing frame 8 by means of the simple screwed installation described above.

The present sectional insert member 1 constructed of sheet metal, inserted, and secured in the described manner thus provides an extraordinarily strong reinforcing and mounting structure for frames, e.g. window frames, with exceptional resistance to bending forces as indicated by arrow A in FIG. 1. The manufacture as well as the installation or assembly of the component parts themselves are quite simple.

Although the invention has been described with reference to specific example embodiments, it will be appreciated, that it is intended to cover all modifications and equivalents within the scope of the appended claims.

What I claim is:

1. A reinforcing and mounting structure for frames, especially window frames, comprising a hollow frame member defining a longitudinally extending channel inside said frame member, sectional insert means inserted in said longitudinal channel for reinforcing said hollow frame member, said sectional insert means comprising two half members each having an approximately U-shaped cross-section including a base shank and two leg shanks, said two half members being arranged with their base shanks mirror-symmetrically and in back-to-back fashion inside said longitudinally extending channel, each base shank comprising two lengthwise extending parallel pleats spaced a distance apart from one another, said pleats facing each other for forming two hollow screw channels extending lengthwise between said two half members for receiving screws, said two half members being so dimensioned that at least ends of said half members are wedged apart by screws received lengthwise in said screw channels for securing said sectional insert means inside said longitudinally extending channel.

2. The structure of claim 1, wherein said hollow frame member has two opposite side walls with a given clearance between said opposite side walls, said leg shanks being so dimensioend that said leg shanks together have a length shorter than said given clearance, whereby said insert member halves may be inserted with play into said hollow frame member, and whereby screws screwed into said screw receiving channels wedge apart said two half members to take up said play and to hold said sectional insert means in said hollow frame member.

3. The structure of claim 1, wherein each of said leg shanks comprises a rim bent inwardly at a right angle to be essentially parallel to said base shank.

4. The structure of claim 1, wherein each of said leg shanks comprises a rim folded completely back along an inside surface of said leg shank and along said pleat of said base shank, whereby the folded back rim covers the respective pleat.

5. The structure of claim 1, wherein said screw receiving channels formed by said pleats have an essentially rectangular cross-section.

6. The structure of claim 1, wherein said base shank is longer than each of said leg shanks.

7. The structure of claim 1, wherein each said two half members is made of sheet steel bent into said U-shape.

8. A reinforcing and mounting structure for frames, comprising a hollow sectional channel member, two insert halves each having at least one pleat arranged to face the other pleat when said insert halves are inserted back-to-back into said hollow sectional channel member, each pleat having a ridge, whereby both ridges face away from each other, said pleats forming a screw receiving channel, whereby a screw inserted into the screw receiving channel wedges said ridges against said sectional channel member.

* * * * *